United States Patent [19]

Haddad

[11] Patent Number: 5,042,511

[45] Date of Patent: Aug. 27, 1991

[54] APPARATUS AND METHOD FOR SELECTIVE COLORING OF HAIR

[76] Inventor: Khalil Haddad, 22 Xavier, Aylmer, Quebec, Canada, J9H 5B4

[21] Appl. No.: 453,773

[22] Filed: Dec. 20, 1989

[51] Int. Cl.[5] ..... A61K 7/13

[52] U.S. Cl. ..... 132/208; 132/222; 132/270

[58] Field of Search ..... 132/53, 54, 208, 270, 132/273, 274, 212, 222

[56] References Cited

U.S. PATENT DOCUMENTS

| | | | |
|---|---|---|---|
| 1,375,381 | 4/1921 | Golden | 132/274 |
| 1,589,185 | 6/1926 | Lithgow | 132/273 |
| 2,642,880 | 6/1953 | Corette | 132/274 |
| 4,750,500 | 6/1988 | Allen | 132/212 |

FOREIGN PATENT DOCUMENTS

| | | | |
|---|---|---|---|
| 17463 | of 1929 | Australia | 132/212 |
| 364546 | 11/1922 | Fed. Rep. of Germany | 132/273 |
| 623429 | 6/1927 | France | 132/274 |
| 233107 | 5/1925 | United Kingdom | 132/274 |
| 866292 | 4/1961 | United Kingdom | 132/273 |

*Primary Examiner*—John J. Wilson
*Assistant Examiner*—Frank A. LaViola

[57] ABSTRACT

There is described a device and a method of selective coloring of hair. The device comprises an open helmet made of a circumferential head band and one or more brace bands extending from the head band over the crown of the wearer's head. The helmet has a plaurlity of fastening means, e.g. pins with knob-like ends, adapted to accommodate a plurality of eyelets. The head band is placed over the wearer's scalp just below the hairline. The brace band then defines two hair sectors on the scalp. Strands of hair from each each sector are consecutively placed in the plastic bags which are then attached by way of the eyelets to the pins of the bands. The hair in the bags is treated with coloring solution. After a predetermined amount of time, the bags and the helmet are removed from the "streaked" hair. The method of the invention eliminates pulling of hair. The device is amenable to repeated use.

14 Claims, 2 Drawing Sheets

APPARATUS AND METHOD FOR SELECTIVE COLORING OF HAIR

BACKGROUND OF THE INVENTION

This invention relates to a device for selective coloring of hair, particularly for streaking or frosting hair, and to a method of coloring hair using the device in such a way as to apply a suitable hair dye to selected hair areas rather than to an entire head of hair.

The problem of coloring selected areas of hair has already been addressed in various ways. Poole et al, in U.S. Pat. No. 3,349,781, proposed a method of streaking hair by combing the hair into sectors, separating a layer of hair from one sector using a protective sheet of flexible material material, and brushing the separated layer with a brush having spaced tufts. After all the hair has been treated in this way, the head is wrapped with aluminum foil and the hair allowed to dry.

Another prior art hair frosting, or streaking, method involves covering the head with a tightly fitting cap provided with a series of distributed apertures. Tufts of hair are drawn through the apertures outside of the cap by means of a crochet needle and treated with a coloring agent. Thus, a distinct coloration is imparted to the isolated tufts of hair, giving the desired streaking, or frosting, effect.

Other methods and devices have been described in U.S. Pat. Nos. 3,692,032; 4,144,897; 4,196,741; 4,224,954; and 4,398,549. These patents all propose some types of hair isolating means, i.e. foldable sheets, purses, "compacts" and the like, some of them associated with hair engaging means such as clamps (U.S. Pat. No. 3,692,032) or adhesive strips (U.S. Pat. No. 4,196,741). According to U.S. Pat. No. 4,298,549, hair may be isolated in a purse which clamps tufts of hair at one edge when closed.

Schmidt (U.S. Pat. No. 1,438,141) and Neff (U.S. Pat. Nos. 2,609,823 and 2,609,824) propose hair restraining devices. The device of Schmidt consists of a circumferential tape, or band, to which is attached a plurality of elastic tapes adapted to be stretched across the crown of the head so as to hold the hair in proper position. The devices of Neff provide an arrangement of non-elastic tapes for the same purpose.

U.S. Pat. No. 4,074,964 to Wells proposes to divide the subject's hair into individual sectors, separated by part lines. Lengths of single-side adhesive tape are fixed along the part lines and covered by corresponding lengths of double-side adhesive tape. Liquid impervious sheets are placed against the hair so that their corners contact the adhesive surface of two angled tape sections. Locks of hair are placed on a sheet, treated with a coloring agent, and then the sheet is rolled up from the bottom edge and attached to the adhesive tapes to maintain the rolled hair packet in place.

While the Wells device is useful, it would be desirable to eliminate the use of adhesive tape which involves pulling hair and thus some discomfort, while providing a convenient holding "frame" for the hair isolating means.

Therefore, one of the principal objects of the present invention is to provide a method of color streaking hair which reduces the discomfort to the subject, particularly due to hair pulling.

Another object of this invention is to provide a method of streaking hair which would eliminate hair tensioning associated with hair rolling.

Still another object of this invention is to provide a hair streaking device which is amenable to repeated use and would constitute a convenient frame for a plurality of hair isolating means.

SUMMARY OF THE INVENTION

For the purpose of clarity, the following definitions will be used throughout the disclosure:

a circumferential head band is a band that is adapted, or adaptable, to encompass the subject's head of hair about the hairline, thus leaving most of or entire hair above the band;

a brace band is a band that is attached at its end to the circumferential head band and extends over the crown of the head.

According to one aspect of the invention, there is provided a device for streaking, frosting or coloring hair, which comprises a circumferential head band, at least one brace band, and a number of liquid impermeable hair isolating means. Each hair isolating means has at least two first fastening means, while the head band and brace band each have a plurality of second fastening means distributed along their length, the first and the second fastening means constituting together a detachable fastening assembly.

Preferably, the head band is provided with length adjustment means. The brace band may be provided with such means as well.

The device may be provided with additional attachment means for securing the device on the subject's head.

According to another aspect of the invention, there is provided a method of coloring hair which comprises:

(a) positioning a device comprising a circumferential head band and a brace band attached thereto at its ends, over the subject's scalp so that the head band extends just below the hairline of the scalp and the brace band extends over the crown of the head thus defining two sectors of hair limited by the head band and the brace band, both said bands having a plurality of non-adhesive second fastening means distributed along their length, (b) detaching at least one strand of hair from one of the sectors, (c) laying said strand on a foldable liquid impervious sheet having lateral closure means and non-adhesive first fastening means matching the second fastening means, the sheet sized to span with its first fastening means at least two second fastening means of the bands, (d) applying a coloring agent to the strand of hair, (e) folding lengthwise and closing said sheet to form a bag-type hair isolating means, (f) attaching the hair isolating means to one or two of the bands by engaging the first with the second fastening means, (g) allowing hair coloring to take effect, and (h) removing the bands and the hair isolating means from the scalp.

This procedure may be repeated a predetermined number of times for each of the sectors to form a desired pattern of hair coloring.

It will be appreciated that the hair isolating means, for example, foldable plastic sheets, may be of a suitable size to match the varying distances between the second fastening means of the head band and the brace band.

Further objects and advantages of the invention will become apparent from the following description of an exemplary preferred embodiment of the invention, when read in conjunction with the accompanying drawings.

DETAILED DESCRIPTION OF THE PRESENT INVENTION

Figure 1:
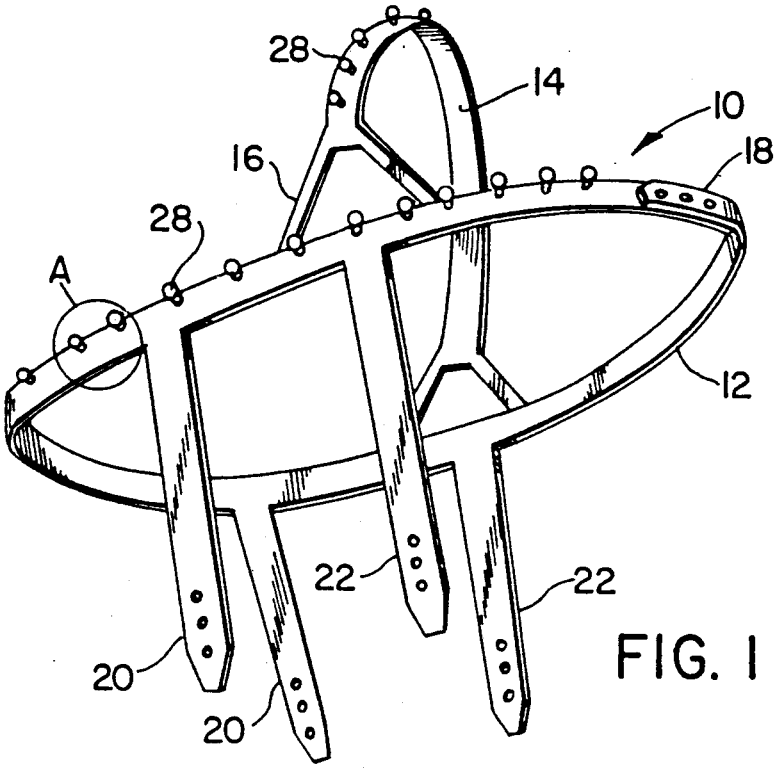
FIG. 1 is a perspective view of one embodiment of the device of the invention without hair isolating means.
Figure 2:
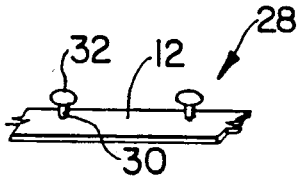
FIG. 2 is an enlarged view of a detail "A" of FIG. 1.
Figure 5:
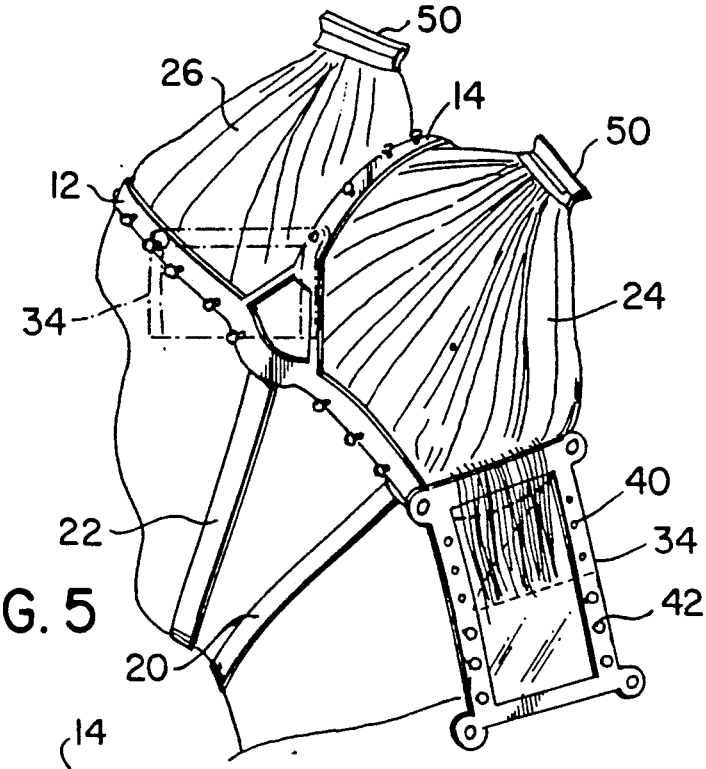
FIG. 5 is a perspective view showing the device positioned on the head of a wearer with two hair isolating means.
Figure 6:
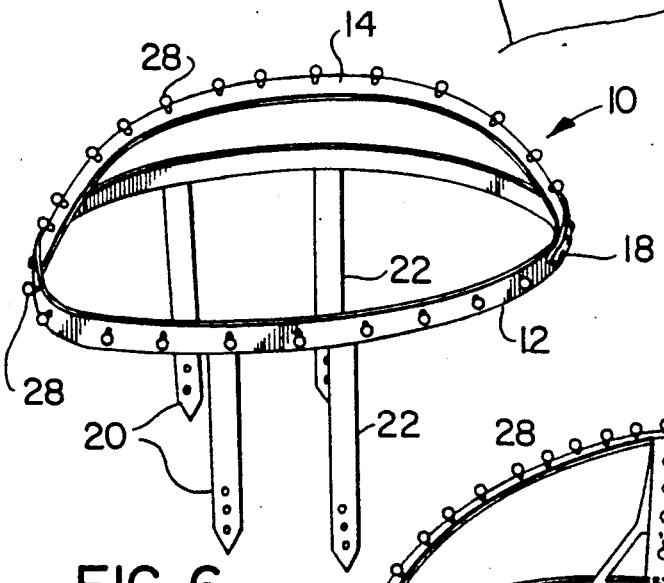
FIG. 6 shows another embodiment of the device.

In the drawings in which like reference characters designate like or corresponding parts throughout the figures, there is shown a device for streaking, frosting, etc. hair. The device comprises a helmet 10 formed of a head band 12 and a brace band 14. The latter is fastened directly to the head band 12 at two ends, as shown in FIG. 6, or by way of bifurcated straps 16 as shown in FIGS. 1 and 5. The head band is preferably made of plastic or fabric and has snap fasteners 18 at its free ends to serve as length adjustment means. The brace band 14 is made of a resilient, stretchable material, e.g. rubber or a similar material. Alternatively, the brace band may be provided with length adjustment means. The length of the head band should be adjusted to the size of a wearer's head so that when positioned on the head, the head band encompasses the head at or closely below the hair line without undue pressure on the head, but so as to avoid slipping away from the desired position.

The brace band 14 as shown in FIG. 5 and FIG. 6 is adapted to extend from the circumferential head band 12 over the crown of the wearer's head. It can be seen that the bifurcated ends 16 of the brace band 14 accommodate the wearer's ears.

As shown in FIGS. 1, 5 and 6, the helmet 10 is also provided with a neck strap 20 and a chin strap 22 which serve to secure the helmet 10 on the head. The straps 20, 22 are provided with snap fasteners for adjusting the length of the straps.

As illustrated in FIG. 5, the brace band 14 divides the hair of a user's scalp into two distinct sectors 24 and 26. The brace band extends across the head of a wearer. Alternatively, as shown in FIG. 6, the brace band 14 can be secured to the head band at different points so that the resulting hair sectors are divided lengthwise, front-to-back.

It is also conceivable to provide two brace bands instead of one. These brace bands would preferably extend crosswise, as illustrated in FIG. 5. This would result in three hair sectors of small surface areas. In the embodiment illustrated herein, the brace band is permanently attached to the head band. Alternatively, a detachable connection, e.g. by snap fastener, enabling the brace to be placed at a different position, may be provided.

Figure 7:
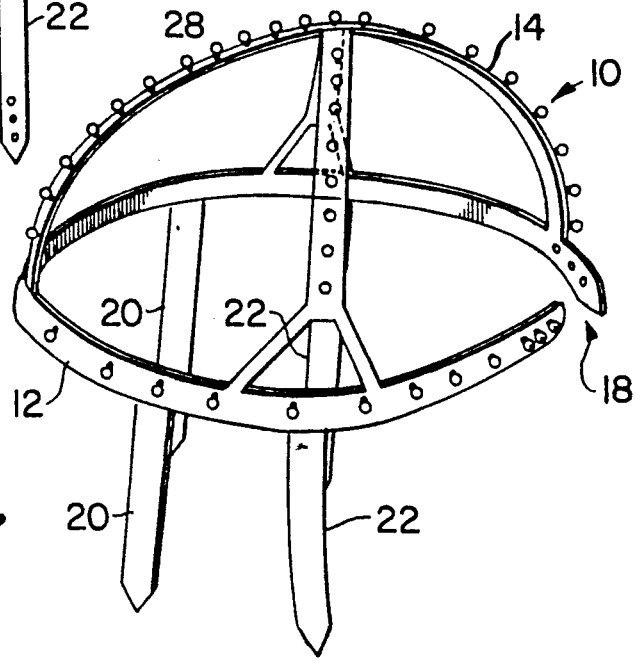
FIG. 7 illustrates still another embodiment of the device.

As shown in FIG. 7, it is also possible to provide a helmet 10 with two brace bands 14 attached to the circumferential head band 12 so that one of the brace bands extends front-to-back and the other across the head of the wearer when in use. They cross approximately at the top, or crown, of the wearer's head, and they may be permanently or releasably attached to each other at that point. The arrangement of FIG. 7 has the obvious advantage of facilitating the application of the hair-holding bags.

As illustrated in FIGS. 1, 2, 5, 6 and 7, the head band 12 and brace band 14 are each provided with a plurality of pins 28. Each pin, integral with or fastened to the respective band, has a short stem 30 and a bead 32 of a size considerably larger than the diameter of the short stem 30. The pins 28 are spaced by approximately 2 cm, but the distance is not critical. The pins are disposed on the sides of the band such that the attached means will be close to the roots of the hair.

Figure 3:
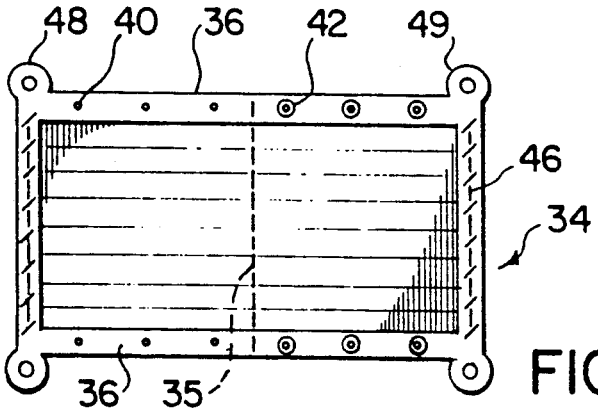
FIG. 3 is a plan view of a hair isolating means with its elastic strips stretched.
Figure 4:
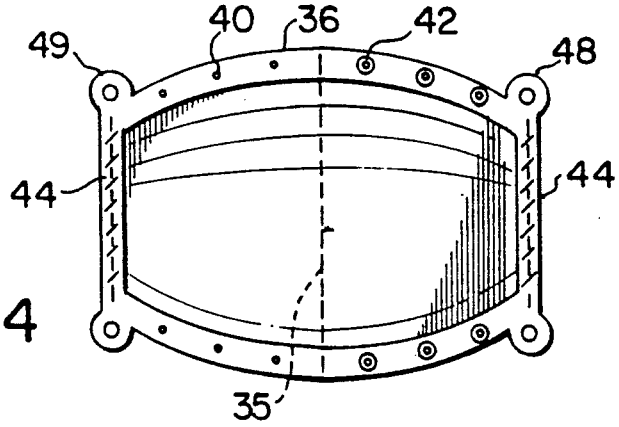
FIG. 4 is a plan view of a hair isolating means in a normal position.

Another essential element of the device of the invention is a plurality of hair isolating means, one of which is illustrated, by way of a preferred embodiment, in FIGS. 3 and 4. The hair isolating means is a plastic, liquid impermeable, generally rectangular sheet 34. The sheet is foldable along a line 35 and has two lateral strips 36 with snap fasteners positioned so that the balls 40 and sockets 42 enable the sides of the sheet 34 to be closed to form a bag. The free ends 44 are provided each with a strip 46 of rubber-like material, the normal length of the strip 46 being smaller than the length of the free ends 44.

This arrangement results in the free ends 44 of the sheet 34 staying normally in a contracted position, as shown in FIG. 4. When stretched, the free ends 44 expand so that the sheet assumes the initial rectangular shape.

At the ends of the strips 46 are provided eyelets 48, 49 with apertures receivable on the beads 32 of the pins 28, so as to enable the sheets 34 to be attached to the pins 28 and detached therefrom in a convenient manner.

It will be appreciated that the fastening means illustrated herein, viz, the pins and eyelets, are non-adhesive fastening means. This offers a clear advantage in that hair does not adhere to the elements of the device of the present invention. It will be appreciated, however, that other non-adhesive fastening means, e.g. snap fasteners, may also be used instead of the pins and eyelets, which are proposed as a preferable embodiment of the fastening assembly of the invention.

The method of selective coloring of hair using the above-described device will now be described in detail.

The helmet 10 is positioned first on the wearer's head as illustrated in FIG. 5, the head band extending just below the hairline and the brace band extending over the crown of the head, approximately in the middle of the scalp. Next, assuming that the hair is relatively long, the two sectors of hair, 24 and 26, are prepared by pulling the hair from each sector together and securing it in a bundle with clips 50. More than one bundle of hair may be made in each sector. Thus, relatively little hair remains beneath the brace band and below the head band.

In the next step, a strand of hair is detached from one of the bundles, say, in sector 24, at the nape of the neck. The tuft is combed down, a plastic sheet 34 is placed over the tuft of hair and attached to the nearest band or bands 12, 14 by means of two eyelets 48 at one end 44. Next, using the tail of a comb, the tuft of hair is brought from under to over the plastic sheet. A coloring solution is applied onto the strand by means of a brush and then the plastic sheet is folded in the middle, along line 35, and closed at its sides by means of snap fasteners 40, 42 to form a bag. The remaining eyelets 49 are placed over the same pins as the eyelets 48.

When placing the eyelets over the pins, it is preferable to select a pair of pins so spaced as to necessitate certain stretching of the resilient strips 46. Thus, when the hair is placed in the bag and the eyelets are positioned over the pins, the strips 46 tighten the open end of the bag thus delaying the drying of the coloring solution.

FIG. 5 shows one plastic sheet 34 before folding, attached to the head band at the back of the head. Another sheet is illustrated in phantom lines as folded and attached to the head band and the brace band.

The above-described procedure (steps 6–8) is then repeated sufficient number of times until a desired amount of hair is treated and enclosed in the plastic bags. It will be appreciated that the method of this invention involves virtually no pulling nor tensioning of hair.

The geometry of the human head imposes certain restrictions on the device and the method of the invention. The distance between two nearest bands becomes greater towards the centre of each sector of hair as illustrated herein. This problem can be dealt with in two ways. First, the sheets can be available in two, three or more sizes, the largest to be used for hair in the middle of each sector. Secondly, two or more brace bands can be provided instead of one, to shorten the distance between the bands and facilitate the use of smaller bags.

Further modifications will be apparent to those skilled in the art, such modifications not departing from the spirit and scope of the present invention as defined in the appended claims.

I claim:

1. A device for selective coloring of hair adapted to be removably secured to a subject's head, comprising a circumferential head band, a brace band and liquid impermeable hair isolating means, said circumferential head band adapted to encompass a subject's head at the hairline, at least one brace band connected at its ends to said head band and adapted to extend over the top of the head, and a number of liquid impermeable hair isolating means, each hair isolating means having at least two first fastening means, said head band and said brace band having a plurality of second fastening means, the first and the second fastening means constituting together a detachable fastening assembly.

2. The device according to claim 1, wherein the head band further comprises length adjustment means.

3. The device according to claim 1, wherein the brace band further comprises length adjustment means.

4. The device according to claim 1, further comprising means for holding the device in place on the head.

5. The device according to claim 4, wherein the holding means comprises a neck strap adapted to extend from the head band around the chin of the subject's head.

6. The device according to claim 1, wherein the hair isolating means are foldable sheets having lateral closure means for closing the sheets when folded into bags each having two walls and an open end, said first fastening means being provided at the open end.

7. The device according to claim 6 wherein said first fastening means are apertures.

8. The device according to claim 6 wherein said second fastening means are pins.

9. The device according to claim 6 wherein each bag has an elastic strip fixed on at least one of the walls proximate the open end, the elastic strip normally being of a length substantially smaller than the length of the open end.

10. A method of coloring hair which comprises, positioning a device comprising a circumferential head band and at least one brace band connected at its two ends to the head band, over the subject's scalp so that the head band extends just below the hairline of the scalp and at least one brace band extends over the crown of the head thus defining at least two hair sectors limited by the head band and at least one brace band, said bands each having a plurality of second fastening means distributed along their length;

separating at least one strand of hair from one of the sectors;

laying said strand on a foldable liquid impervious sheet having lateral closure means, and first fastening means matching the second fastening means, the sheet sized to span with its first fastening means at least two second fastening means of the bands;

applying a color agent to said strand of hair, folding lengthwise and closing said sheet to form a bag-like hair isolating means and attaching said hair isolating means to one or two of said bands by engaging the first and the second fastening means;

allowing the agent to effect the coloring; and removing said hair isolating means.

11. The method according to claim 10 wherein said procedure is repeated for each of said sectors a sufficient number of times to obtain a desired pattern of hair coloring.

12. The method according to claim 10 wherein after the positioning of said device over the subject's scalp, the hair in each sector thus defined is pulled together to facilitate the selection of the strands.

13. The method according to claim 10 wherein the first and the second fastening means are non-adhesive fastening means.

14. Hair isolating means for use with circumferential and support bands for selective coloring of hair where the isolating means is a foldable sheet having two free ends and having closure means along lateral edges thereof for forming said sheet into a bag said bag having opposing side walls formed by the folding of said sheet and an open end having an opening formed by said two free ends of said foldable sheet upon folding of same, said free ends including a strip of elastic material along the width thereof of a length substantially smaller than the width of the free end whereby said free ends are normally in a contracted position, said free ends having fastening means at opposing lateral ends thereof adapted to be fastened to fastening means on said circumferential and support bands.

* * * * *